United States Patent [19]

Ballard

[11] 3,934,390

[45] Jan. 27, 1976

[54] DEBRIS COLLECTOR

[76] Inventor: Alexander K. S. Ballard, P.O. Box 24772, Los Angeles, Calif. 90024

[22] Filed: Jan. 17, 1974

[21] Appl. No.: 434,266

[52] U.S. Cl. ..... 56/400.02; 56/400.03; 172/544; 172/545; 172/547; 172/21

[51] Int. Cl.[2] ..... A01D 7/10

[58] Field of Search ..... 56/328 R, 400.02, 400.03, 56/16.1; 172/21, 547, 545, 548, 544, 543; 171/63

[56] References Cited

UNITED STATES PATENTS

| | | | |
|---|---|---|---|
| 327,713 | 10/1885 | Nelson | 172/607 |
| 809,523 | 1/1906 | McNally | 172/547 |
| 1,104,431 | 7/1914 | Lint | 56/328 R |
| 2,845,884 | 8/1958 | Clausing | 172/21 |

*Primary Examiner*—Louis G. Mancene
*Assistant Examiner*—James D. Hamilton

[57] ABSTRACT

A device for picking up debris from lawns and like grounds, and comprised of a rolling drum motivated and controlled through a handle, and having retractile spikes for collectively piercing leaves and small bits of paper and like refuse, said spikes being yieldingly depressible to ground obstructions, such as protrusions, and retractile by control means to discharge the collection thereby of said debris. The depressibly retractile spikes are arranged in gangs guided radially by the cooperative drum structure, and the control means is uneffected by rotation of the drum or by said yielding depressibility of the gangs of spikes and is manually operable to retract the same as circumstances require.

6 Claims, 5 Drawing Figures

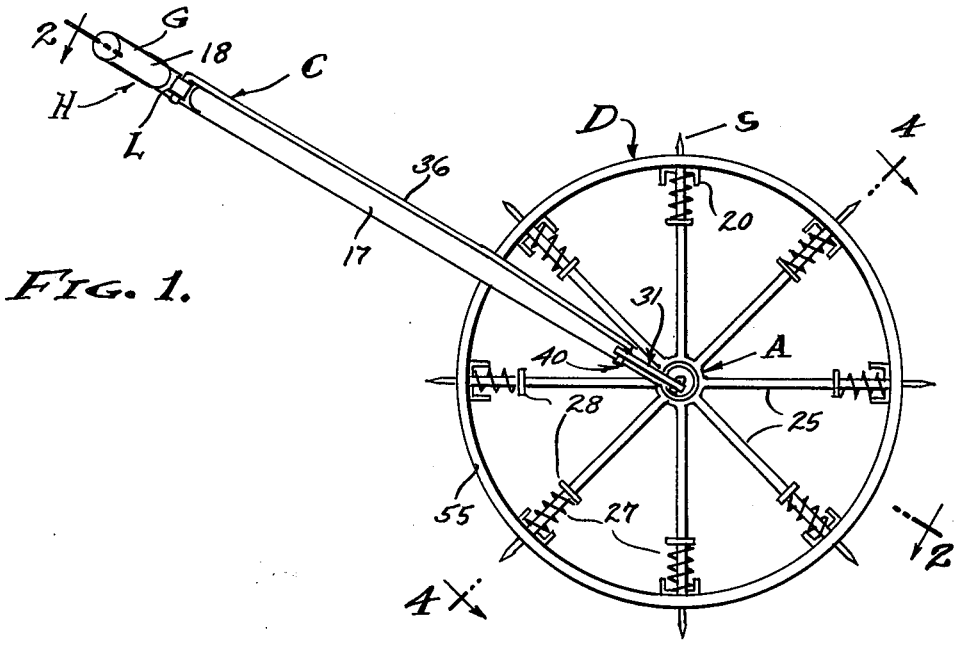
FIG. 1.
FIG. 2.
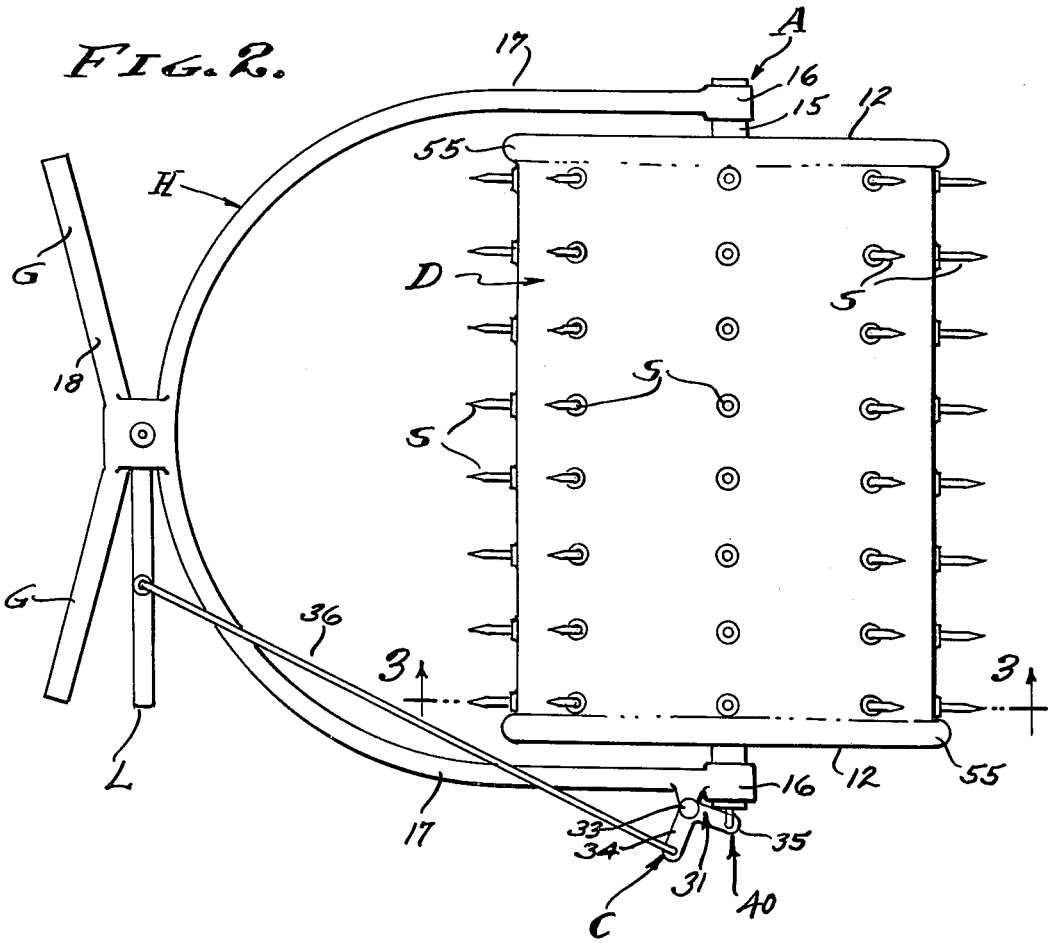

FIG. 3.
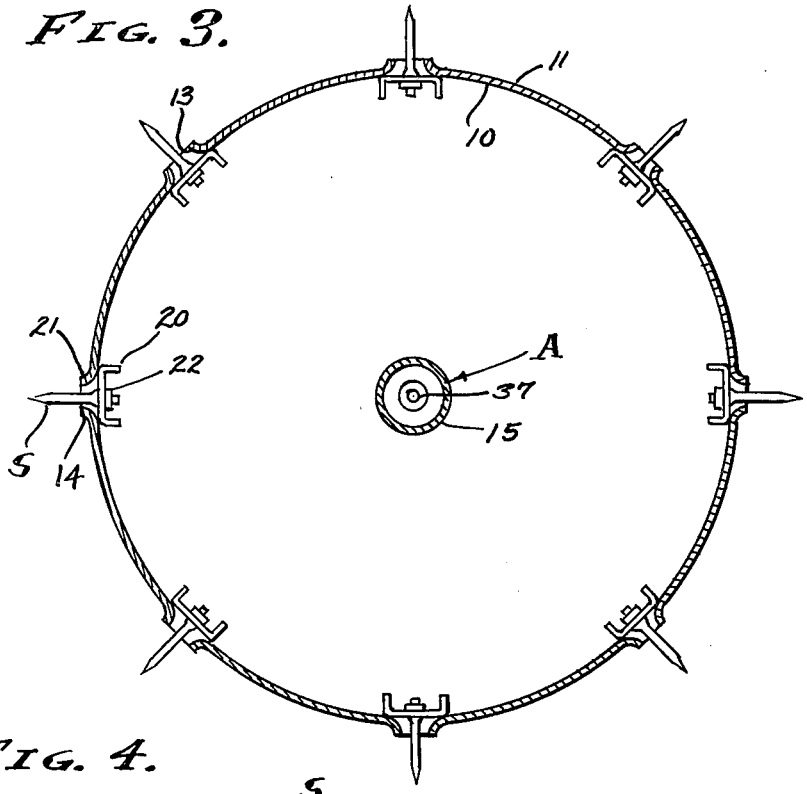
FIG. 4.
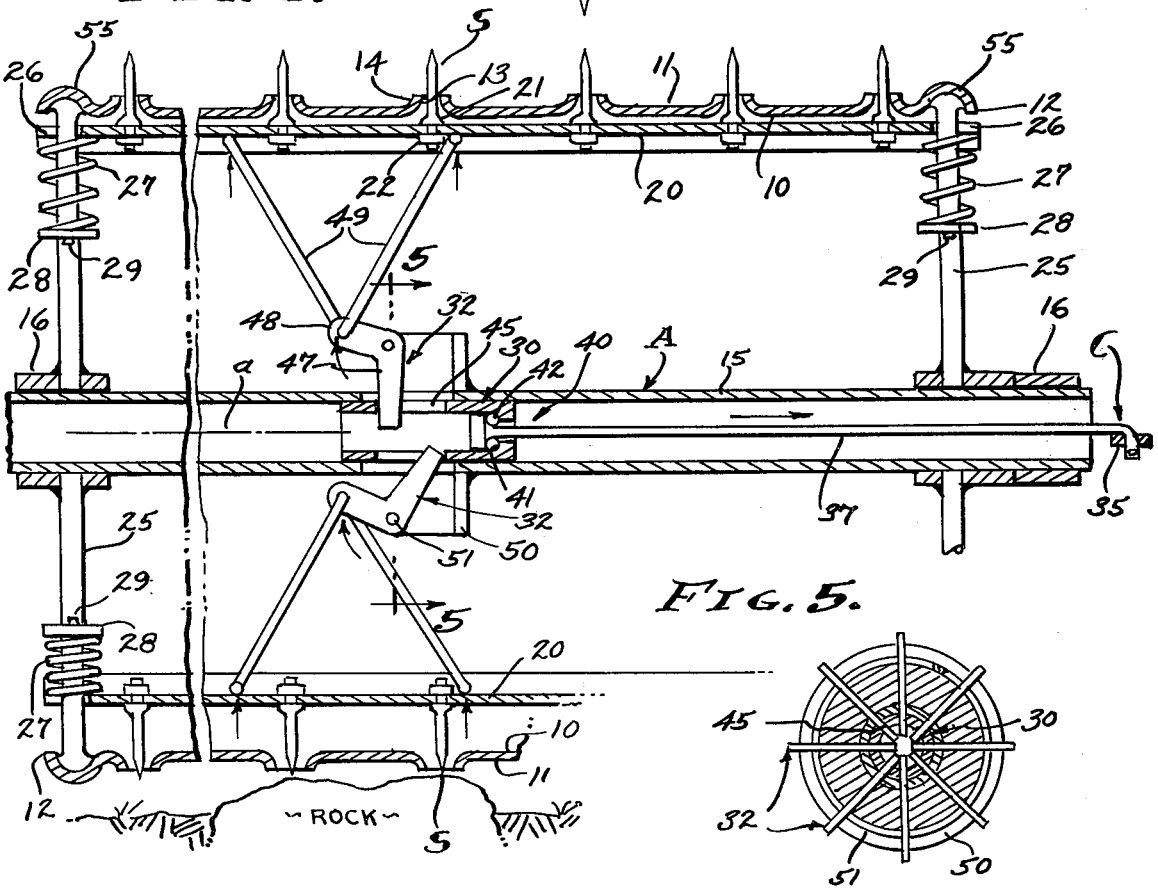
FIG. 5.

DEBRIS COLLECTOR

BACKGROUND

Refuse in the form of small pieces of debris such as leaves and papers (wrappers) are generally gathered by hand or with spiked tools when sparcely distributed, or by sweeping methods when densely distributed. In any case, work is involved which is considered tedious and time consuming when compared with the trivial matter of the material collected. It is an object, therefore, to provide a device to facilitate and accelerate the process of removing debris from lawns and such grounds. With the present invention, a rolling drum is provided upon which debris is collected by impaling the same upon protruding spikes. Heretofore, the spikes of such drums have been vulnerable to damage and the stripping means provided to remove debris have been complex and cumbersome; and it is to expediency and improvement of such a drum that I provide yieldingly retractile spikes that are not readily damaged by obstructions such as rocks, or curbs, or sprinkler heads, etc., and wherein the spikes are retractile for stripping the collected debris as and when desired.

It is an object of this invention to provide spike retraction means in a drum of the character thus far referred to that permits rotation of the drum while retaining controllability. With the present invention, the control means is confined within the workings of the drum and is cooperatively related thereto to permit depression of the spikes independent from the controllable retraction thereof.

It is also an object of this invention to provide yieldable spike support in a drum of the character thus far referred to that permits controllability while rotation and independent depression and retraction can simultaneously occur. With the present invention, the depressible support is cooperatively combined within the workings of the drum and rotation means, there being a manual control means to govern the retraction that strips debris from said yieldingly retracted spikes.

SUMMARY OF THE INVENTION

The debris collector hereinafter described in detail involves, generally, a drum D that is motivated by and controlled from a handle H. The handle has spaced bearings that journal the axle A of the drum and which extends radially to present grips G by which the device is manipulated for motivation. Within the drum there is provided one or more and preferably a multiplicity of gangs of spikes S, there being a plurality of transverse series of spikes in each gang. In accordance with this invention, each gang of spikes is yieldingly depressible to radial force applied externally, and to this end depressible support means B is provided therefor. And also, in accordance with this invention, each gang of spikes, and preferably all spikes in unison, is retracted when desired through a manually operable control means C, operating through the axle A and adapted to permit independent depression of the spikes in gangs thereof.

DRAWINGS

The various objects and features of this invention will be fully understood from the following detailed description of the typical preferred form and application thereof, throughout which description reference is made to the accompanying drawings, in which:

FIG. 1 is a side elevation of the debris collector of the present invention.

FIG. 2 is a plan view taken as indicated by line 2—2 on FIG. 1.

FIG. 3 is an enlarged cross sectional view taken as indicated by line 3—3 on FIG. 2.

FIG. 4 is also an enlarged sectional view taken as indicated by line 4—4 on FIG. 1, and FIG. 5 is a sectional view taken as indicated by line 5—5 on FIG. 4.

PREFERRED EMBODIMENT

Referring now to the drawings: the drum D is an open ended right cylinder of sheet metal or the like. having inner and outer diameter walls 10 and 11, and with opposite ends 12 disposed in spaced planes normal to the axis *a* of the cylinder. The axle A is tubular in accordance with this invention, so as to cooperatively house the actuating elements of the control means C. As shown, the axle tube 15 extends axially beyond each end 12 where it presents spaced bearing surfaces upon which the drum turns on spaced journal bearings 16 carried by the spaced side members 17 of the handle H, with the grips G in the form of a cross member 18. Thus, it will be seen that the drum D is rotatable on axis *a* as it is propelled and steered by the handle H.

Referring now to the depressible support means B for the spikes S, it is preferred that the spikes be arranged in transverse series or gangs with each individual spike free to project through an opening 13 provided therefore in the drum. In practice, the openings 13 are swaged outwardly from the inner wall 10 and each presents a conical embossment 14 at the exterior or outer wall 11. The embossment 14 is of limited height and through which the spike closely passes so as to strip debris therefrom when retracted. The longitudinal distribution of spikes S is uniform, the plurality of spikes being carried by a radially shiftable bar 20 to which they are mounted so as to project through the aforementioned openings respectively. Each spike S is shown with a base 21 having shouldered engagement upon the bar 20 and secured thereto by a nut 22, all to the end that they are readily replaceable.

The drum D shiftably carries the multiplicity of bars 20, eight bars being shown for example, and are guided radially by spaced and parallel spokes 25 at opposite ends of the drum. Said spokes 25 extend radially between the axle A and inner drum wall, a feature of the invention being the replaceability of the bars 20 which have open longitudinally disposed notches 26 at opposite ends; whereby the bars can be tipped to initiate assembly thereof with the spokes for full embracement of said notches with said spokes when the bar is aligned parallel with the axis *a*, in each instance. Subsequent to said alignment of the bars 20, like compression springs 27 engaged around the spokes are pressed into position by seats 28 that are secured as shown by cotter pins 29 or the like. Thus, the multiple bars 20 and gangs of spikes S carried thereby through a plurality of openings 13 are yieldingly biased outwardly so as to depressibly extend the spikes for ground engagement and collection of debris.

The control means C is independently operable to retract the bars 20 and spikes S, and it comprises a single manual control lever L that retractably reciprocates an actuator 30 within the confines of the axle A. A feature of the invention is that the actuator 30 revolves with the turning axle and drum B and that it is operably connected to lever L by anti-rotation pull means 40. In the preferred form, the lever L retracts the bar 20 radially inward by means of a system of pull rods and levers, there being an actuating lever 31 that transfers movement of the lever L to the axis *a*, and an actuated lever 32 that retracts the bars 20.

The actuating lever 31 is of bell crank configuration pivoted to a side member 17 by a pin 33 normal to and spaced rearward of axis *a*, and is characterized by right angularly related arms 34 and 35. The end of arm 34 is connected to a pull point on lever L by a pull rod 36, while the end of arm 35 is connected to a pull point on said pull means 40 by a pull rod 37 coincidental with axis *a*. In practice, the arm 34 can be longer than arm 35, thereby establishing a desired mechanical advantage with a restricted reciprocation of rod 37 and actuator 30.

The anti-rotation pull means 40 is provided to permit free rotation of the axle A while the lever 31 remains aligned with control lever L. In carrying out this invention, the actuator 30 is a piston member that slides free within the axle A at the center portion thereof where it is exposed through slots to actuate the levers 32, as later described. As shown, the actuator 30 is of tubular cup-shape with an inwardly faced bearing race 41 surrounding the center opening through which the rod 37 projects. The innermost end of rod 37 is headed and presents an outwardly faced bearing race 42, there being ball bearings 43 disposed to roll between the races 41 and 42. Thus, reciprocation of rod 37 results from rotation of actuating lever 31 which transfers the motion of pull rod 36 to pull rod 37, thereby shifting the actuator 30 outwardly within the axle A, to be returned with opposite motions of said rods and levers.

The actuated lever 32 is rotated by outward movement of the actuator 30 to retract the bar 20 with which it is related, in each instance; there being a lever 32 for each of the bars as shown. Accordingly, there is a central axle slot 45 for each lever and bar to be actuated, and a pivot for each lever 32 on an axis normal to and spaced radially from the axis *a*. The actuator 30 is provided with a drive recess or opening for each lever 32, each presenting a shoulder normally engaged with the inwardly projecting drive arm 47 of said lever and preferably extending forwardly with clearance from said arm as a slot, so as to provide free forward movement of said lever when the related bar 20 and spikes S are depressed. The lever 32 is characterized by right angular related arms 47 and 48, the arm 48 being connected by a pull rod 49 to a central pull point on the bar 20 aligned therewith and adapted to be retracted thereby. The lever 32 is in the nature of a rocker having limited motion, and to the end that the pull point of arm 48 draws radially inward when the arm 47 is advanced by outward movement of the drive shoulder 46 of slot 45.

The actuated levers 32 are mounted by means of a collar 50 that surrounds the axle A, and which is slotted radially to rotatably carry each lever 32 in alignment with its respective drive slot. The collar is provided with a circumferential groove into which a split pivot ring 51 is constricted and permanently secured together and in place as by welding. Thus, the weldment of ring 51 establishes a permanent assembly with free moving levers 32 and the actuator 30 captured in working position, the mechanism to be biased by the springs 27 that depressibly hold each bar 20 and its gang of spikes S in extended condition subject to retraction as caused by operation of the manual control lever L.

From the foregoing it will be seen that an effective debris collector is constructed of but few and reliable working parts. The device is adapted to be operated over lawns and regular terrain, and in the event that irregularities are encountered the spikes are commensurately depressible so as to withdraw to the outside wall 11 of the drum. In carrying out this invention, the periphery of the drum is provided with a rim 55 that spaces the outside wall 11 from the supporting surface, thereby providing a collection space for the substantial accumulation of debris. With debris is collected as desired the lever L is manipulated to operate the pull rods and thereby simultaneously withdraw the multiple gangs of spikes with consequent stripping of and release of the debris.

Having described only a typical preferred form and application of my invention, I do not wish to be limited or restricted to the specific details herein set forth, but wish to reserve to myself any modifications or variations that may appear to those skilled in the art:

Having described my invention, I claim:

1. The debris collecting roller comprised of, a drum rotatable on axially spaced aligned pairs of spokes projecting from a tubular axle and motivating means for rolling the same over terrain from which debris is to be collected, yieldingly depressible mounting means comprised of a multiplicity of bars and each moveably guided by and between a pair of said spokes and extending longitudinally within the drum and from which gangs of spikes project through openings in and from the outside wall of the drum, and retraction means including, an actuator axially carried on the drum axis and operable to be shifted axially by control means, and motion transfer means responsive to axial shifting of the actuator to retract the yieldingly depressible mounting means and spikes carried thereby.

2. The debris collecting roller as set forth in claim 1, wherein the actuator of the retraction means is shiftably carried within said tubular axle.

3. The debris collecting roller as set forth in claim 1, wherein the actuator of the retraction means is shiftably carried within said tubular axle and operable through a lever pivoted to the motivating means to be shifted axially by the control means, and wherein said motion transfer means extends radially through said tubular axle and responsive to axial shifting of the actuator to retract the yieldingly depressible mounting means and spikes carried thereby.

4. The debris collecting roller as set forth in claim 1 wherein the actuator of the retraction means is shiftably carried within the tubular axle, and wherein said motion transfer means comprises a lever extending radially through said tubular axle and responsive to axial shifting of the actuator to retract the yieldingly depressible mounting means and spikes carried thereby.

5. The debris collecting roller as set forth is claim 1, wherein the actuator of the retraction means is shiftably carried within said tubular axle and operable through a lever pivoted to the motivating means to be shifted by the control means, and wherein said motion transfer means comprises a lever extending radially through said tubular axle and responsive to axial shifting of the actuator to retract the yieldingly depressible mounting means and spikes carried thereby.

6. The debris collecting roller as set forth in claim 1, wherein the actuator of the retraction means is shiftably carried within said tubular axle and operable through a lever pivoted to the motivating means to be shifted by the control means, and wherein said motion transfer means comprises a lever extending radially through said tubular axle and responsive to axial shifting of the actuator, there being pull rods connected to and extending from said control and between said levers and to said yieldingly depressible mounting means and spikes carried thereby.

* * * * *